US011371747B2

(12) United States Patent
Suehiro et al.

(10) Patent No.: US 11,371,747 B2
(45) Date of Patent: Jun. 28, 2022

(54) INDOOR UNIT OF AIR-CONDITIONING APPARATUS AND AIR-CONDITIONING APPARATUS

(71) Applicant: Mitsubishi Electric Corporation, Tokyo (JP)

(72) Inventors: Hironobu Suehiro, Tokyo (JP); Tatsuo Furuta, Tokyo (JP); Naoya Matsunaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 274 days.

(21) Appl. No.: 16/635,899

(22) PCT Filed: Oct. 6, 2017

(86) PCT No.: PCT/JP2017/036420
§ 371 (c)(1),
(2) Date: Jan. 31, 2020

(87) PCT Pub. No.: WO2019/069442
PCT Pub. Date: Apr. 11, 2019

(65) Prior Publication Data
US 2020/0224923 A1 Jul. 16, 2020

(51) Int. Cl.
*F24F 13/20* (2006.01)
*F24F 11/74* (2018.01)
*F24F 1/0059* (2019.01)

(52) U.S. Cl.
CPC ..... *F24F 13/20* (2013.01); *F24F 11/74* (2018.01); *F24F 1/0059* (2013.01)

(58) Field of Classification Search
CPC ..... F24F 13/20; F24F 13/08; F24F 1/0059; F24F 1/34; F24F 11/74; F24F 2013/207; F24F 2203/1012
See application file for complete search history.

(56) References Cited

U.S. PATENT DOCUMENTS

2017/0045259 A1* 2/2017 Choi ..... F24F 13/222
2017/0370607 A1* 12/2017 Wang ..... F24F 11/30
2019/0049127 A1* 2/2019 Shin ..... F24F 13/22
2019/0249883 A1* 8/2019 Tomomura ..... F24F 13/082
2020/0072489 A1* 3/2020 Nakamura ..... F24F 11/89

FOREIGN PATENT DOCUMENTS

JP H10-103709 A 4/1998
JP H10-311554 A 11/1998
JP 2018189279 A * 11/2018 ..... F24F 13/20
KR 20020033876 A * 5/2002 ..... F24F 1/0068
WO 2013/129527 A1 9/2013

OTHER PUBLICATIONS

International Search Report of the International Searching Authority dated Jan. 9, 2018 for the corresponding International application No. PCT/JP2017/036420 (and English translation).

* cited by examiner

*Primary Examiner* — Nelson J Nieves
(74) *Attorney, Agent, or Firm* — Posz Law Group, PLC

(57) ABSTRACT

The indoor unit of an air-conditioning unit includes: an opening; a cover; a heat medium heat exchanger; and an air processing unit. The air purge valve is positioned on a rear side in a projection direction of the opening inside the casing. The cover includes, on its one side, a single hook protruding from its cover body. The cover includes, on its side opposite to the one side, a temporarily fixing tab configured to temporarily fix the cover to the casing with the cover body closing the opening.

12 Claims, 8 Drawing Sheets

INDOOR UNIT OF AIR-CONDITIONING APPARATUS AND AIR-CONDITIONING APPARATUS

CROSS REFERENCE TO RELATED APPLICATION

This application is a U.S. national stage application of PCT/JP2017/036420 filed on Oct. 6, 2017, the contents of which are incorporated herein by reference.

TECHNICAL FIELD

The present disclosure relates to an indoor unit of an air-conditioning apparatus and an air-conditioning apparatus including an opening in a casing and a cover closing the opening.

BACKGROUND ART

A conventional opening in a casing includes two hooks, and a conventional cover for closing the opening includes two hook holes to engage with the respective two hooks (e.g., see Patent Literature 1).

CITATION LIST

Patent Literature

Patent Literature 1: International Publication No. WO2013/129527

SUMMARY OF INVENTION

Technical Problem

In the technique disclosed in Patent Literature 1, the presence of two hooks and two hook holes necessitates that the two hook holes be engaged with the respective two hooks at the same time. This makes attaching the cover a troublesome work.

In particular, the cover, which is provided with the two hook holes, hides the two hooks on the casing from a user's view when he/she is engaging the two hook holes with the two hooks simultaneously. Thus, the user can hardly see the hook part; as such, it is difficult to ensure the user's visibility.

An indoor unit and an air-conditioning apparatus of the present disclosure have been made in view of the above problem and aim to provide an indoor unit of an air-conditioning apparatus and an air-conditioning apparatus allowing the user to easily attach the cover under good visibility conditions.

Solution to Problem

According to one embodiment of the present disclosure, there is provided an indoor unit of an air-conditioning apparatus, the indoor unit including: an opening in a casing; a cover including a cover body configured to close the opening; a heat medium heat exchanger inside the casing, the heat medium heat exchanger being configured to exchange heat between a heat medium and indoor air; and an air processing unit located at a top of a heat medium flow path configured to allow the heat medium to flow through the heat medium heat exchanger, the air processing unit including an air reservoir and an air purge valve configured to discharge air in the air reservoir, wherein the air purge valve is positioned on a rear side in a projection direction of the opening inside the casing, the cover includes, on one side thereof, a single hook protruding from the cover body, and the cover includes, on an other side thereof opposite to the one side, a temporarily fixing tab configured to temporarily fix the cover to the casing with the cover body closing the opening.

According to another embodiment of the present disclosure, there is provided an air-conditioning apparatus including the above indoor unit of an air-conditioning apparatus.

Advantageous Effects of Invention

The indoor unit of an air-conditioning apparatus and the air-conditioning apparatus according to embodiments of the present disclosure includes, on one side of the cover, the single hook protruding from the cover body of the cover. The cover includes, on its side opposite to the one side, the temporarily fixing tab configured to temporarily fix the cover to the casing with the cover body closing the opening. With this configuration, a user can finish the hooking work just by engaging the single hook provided on the one side of the cover onto the inner periphery of the opening of the casing. This allows for easy attachment of the cover. The cover includes only one hook on its one side, providing visibility so that the user can easily see the hooking part. This allows the user to easily attach the cover under good visibility conditions.

DESCRIPTION OF EMBODIMENTS

Figure 1:
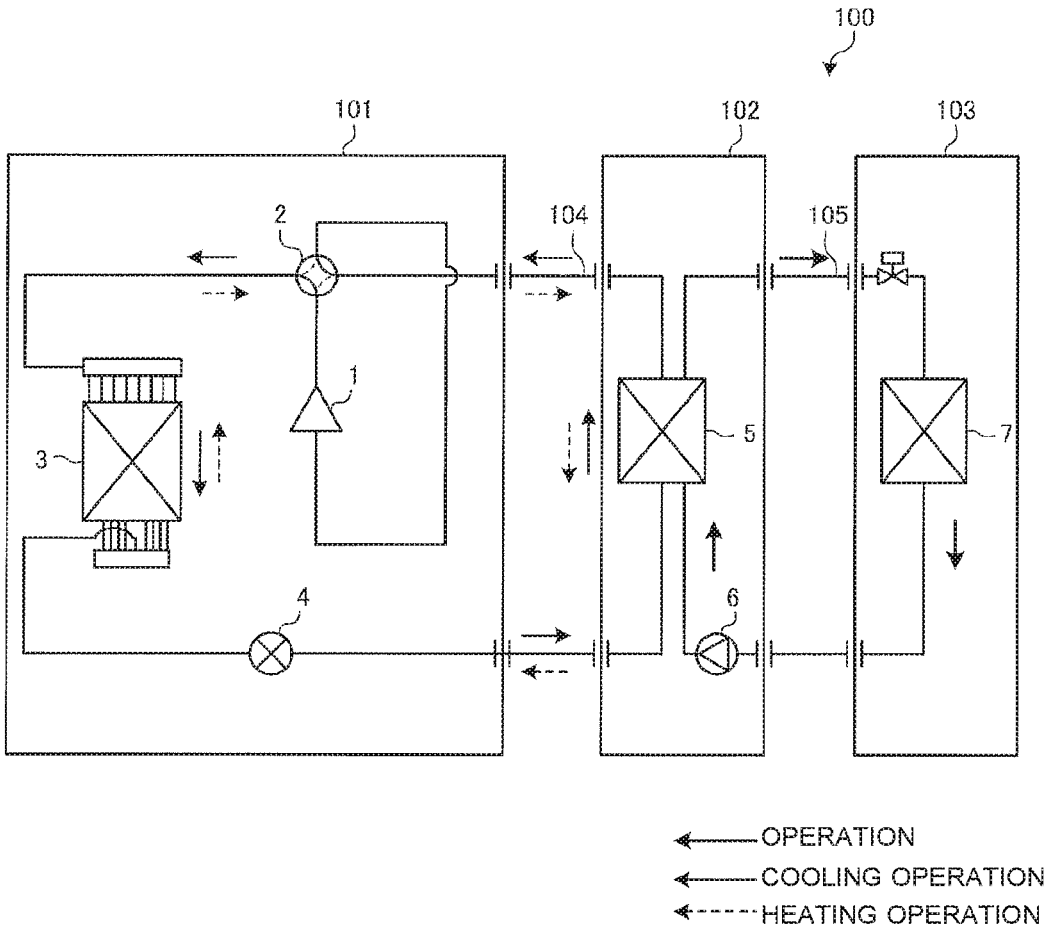
FIG. 1 shows a schematic configuration of an air-conditioning apparatus according to Embodiment 1 of the present disclosure.

Embodiments of the present disclosure will be described below with reference to the drawings. Throughout the drawings, like reference numerals refer to like or corresponding parts. This holds true throughout the specification. The forms of elements given in the specification are by way of example only and not of limitation.

Embodiment 1

<Configuration of the Air-Conditioning Apparatus>

FIG. 1 shows a schematic configuration of the air-conditioning apparatus 100 according to Embodiment 1 of the present disclosure. The air-conditioning apparatus 100 shown in FIG. 1 includes an outdoor unit 101, a relay unit 102, and an indoor unit 103.

The outdoor unit 101 and the relay unit 102 constitute a refrigerant circuit 104. The refrigerant circuit 104 includes a compressor 1, a four-way valve 2, an outdoor heat exchanger 3, an expansion valve 4, and a heat-transferring heat exchanger 5.

The relay unit 102 and the indoor unit 103 constitute a water circuit 105 as a heat medium circuit. The heat medium is a non-flammable medium such as water and brine. Here, water is used as the heat medium. The water circuit 105 includes the heat-transferring heat exchanger 5, a pump 6, and an indoor heat exchanger 7 as a heat medium heat exchanger.

The outdoor unit 101 includes the compressor 1, the four-way valve 2, the outdoor heat exchanger 3, and the expansion valve 4. The outdoor unit 101 includes a fan (not shown) for facilitating heat exchange in the outdoor heat exchanger 3 between outdoor air and refrigerant. The outdoor unit 101 includes a controller (not shown) to control the compressor 1, the four-way valve 2, the expansion valve 4, the fan and other components.

The compressor 1 compresses suctioned refrigerant and discharges it. The four-way valve 2 switches the flow path of refrigerant in a cooling operation and a heating operation. The outdoor heat exchanger 3 exchanges heat between outdoor air and refrigerant. During a cooling operation, the outdoor heat exchanger 3 serves as a condenser to condense and liquefy the refrigerant. During a heating operation, the outdoor heat exchanger 3 serves as an evaporator to evaporate and gasify the refrigerant. The expansion valve 4 regulates pressure of the refrigerant and expands the refrigerant. The refrigerant circuit 104 of the outdoor unit 101 delivers the refrigerant retaining heat, such as cooling energy and heating energy, to the relay unit 102.

The relay unit 102 includes the heat-transferring heat exchanger 5 and the pump 6. The heat-transferring heat exchanger 5 transfers heat, such as cooling energy and heating energy, of the refrigerant flowing in the refrigerant circuit 104 to water flowing in the water circuit 105. During a cooling operation, the heat-transferring heat exchanger 5 serves as an evaporator to evaporate and gasify the refrigerant. During a heating operation, the heat-transferring heat exchanger 5 serves as a condenser to condense and liquefy the refrigerant. The pump 6 regulates the flow rate of water flowing in the water circuit 105. The relay unit 102 includes a controller (not shown) to control the pump 6.

The indoor unit 103 includes the indoor heat exchanger 7 exchanging heat between water and indoor air. The indoor unit 103 includes a fan (not shown) for facilitating heat exchange in the indoor heat exchanger 7 between water and indoor air. The indoor unit 103 includes a controller (not shown) to control the fan and other components.

All of the controllers of the outdoor unit 101, the relay unit 102, and the indoor unit 103 may be provided in one device or they may be separately provided in individual devices. The controller includes a storage unit storing programs and a central processing unit (CPU) executing processes according to the programs.

The above-described air-conditioning apparatus 100 can run the cooling operation or the heating operation by switching the flow path of the refrigerant with the four-way valve 2 of the outdoor unit 101.

<Indoor Unit 103 of the Air-Conditioning Apparatus 100>

Figure 2:
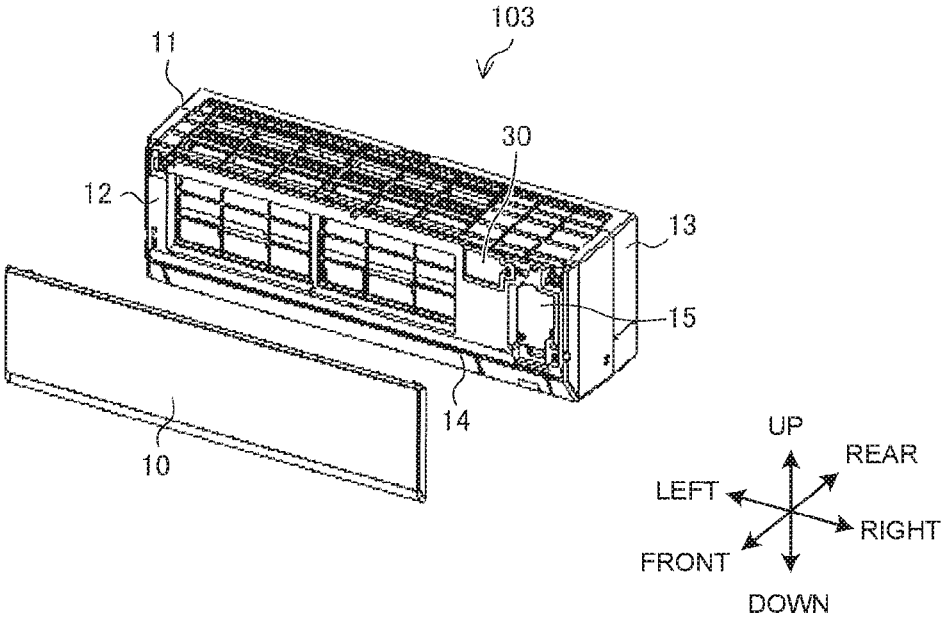
FIG. 2 is a perspective view of an indoor unit of the air-conditioning apparatus with a grille removed according to Embodiment 1 of the present disclosure.

FIG. 2 is a perspective view of the indoor unit 103 of the air-conditioning apparatus 100 with a grille 10 removed according to Embodiment 1 of the present disclosure. The indoor unit 103 shown in FIG. 2 is a wall-mounted indoor unit having the indoor heat exchanger 7 inside a casing 11. The grille 10, a panel 12, a box 13, and a vane 14 constitute an exterior of the rectangular casing 11 of the indoor unit 103. Specifically, the grille 10 is placed on a front side of the panel 12. The panel 12 defines a basic rectangular outline of the casing 11. The box 13 forms a back side of the casing 11 behind the panel 12. The vane 14 is attached to a lower part of the panel 12. The indoor unit 103 includes inside the casing 11 the indoor heat exchanger 7, the fan, and an electric box 15 containing the controller.

An air reservoir 20 and an air purge valve 21 are provided on an intermediate pipe of the water circuit 105 including the indoor heat exchanger 7. The casing 11 of the indoor unit 103 includes an opening 16 on its front side. Through the opening 16, a user can insert his/her fingers into the inside of the casing 11 to operate the air purge valve 21. The opening 16 has a rectangular shape with its side 16*a* having a vertically straight inner periphery to receive a hook 31 of a cover 30. The casing 11 includes the cover 30 having a cover body 32 to close the opening 16. The cover 30 is present between the grille 10 and the panel 12. The cover 30 is fixed with a screw. Removing a screw 40 allows the cover 30 to be removed.

<Configuration of the Air Purge Valve 21 and Surrounding Components>

Figure 3:
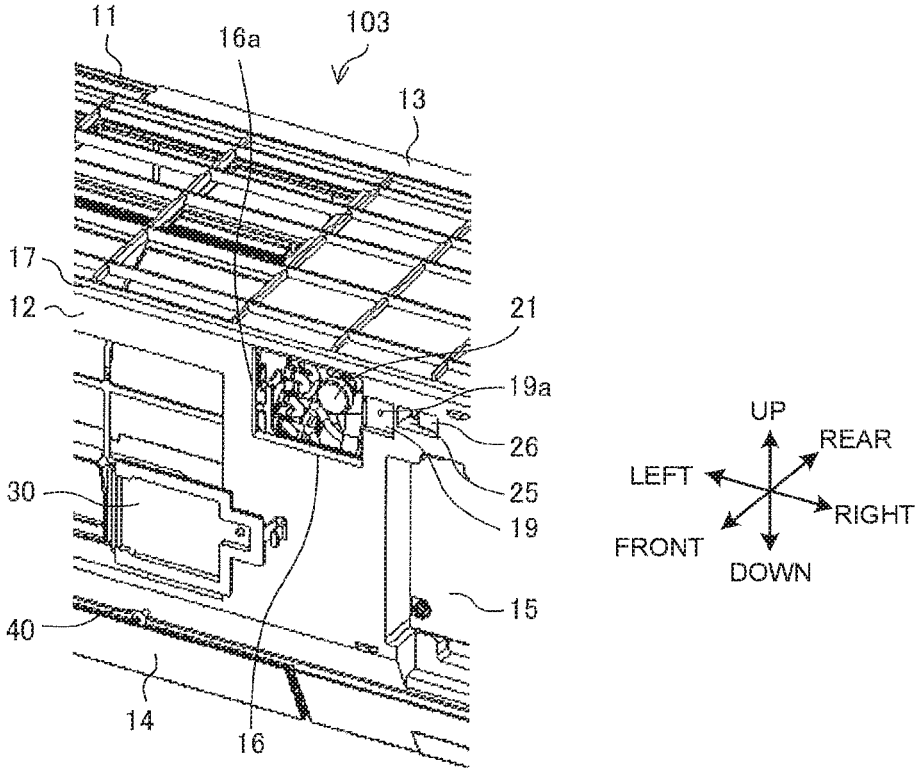
FIG. 3 is an enlarged perspective view of a part of the indoor unit of the air-conditioning apparatus with a cover removed according to Embodiment 1 of the present disclosure.
Figure 4:
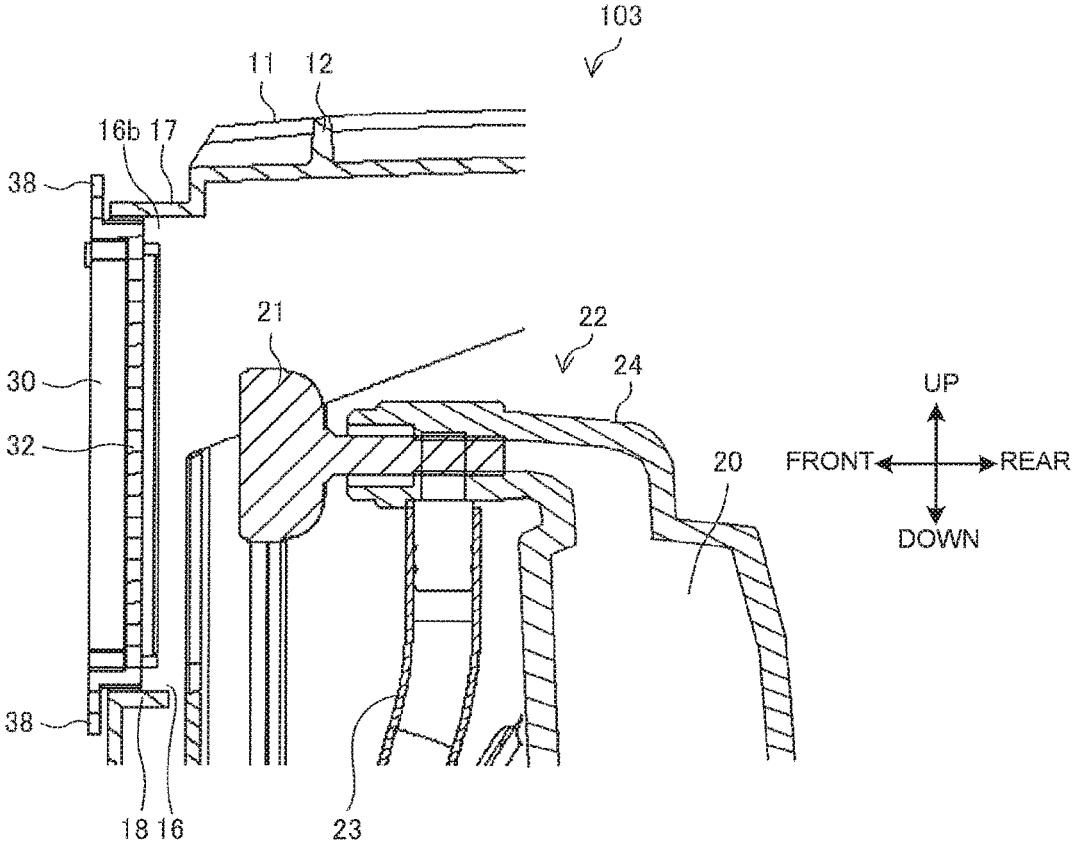
FIG. 4 is an enlarged longitudinal-sectional view of a cover and an air purge valve of the indoor unit of the air-conditioning apparatus according to Embodiment 1 of the present disclosure.
Figure 5:
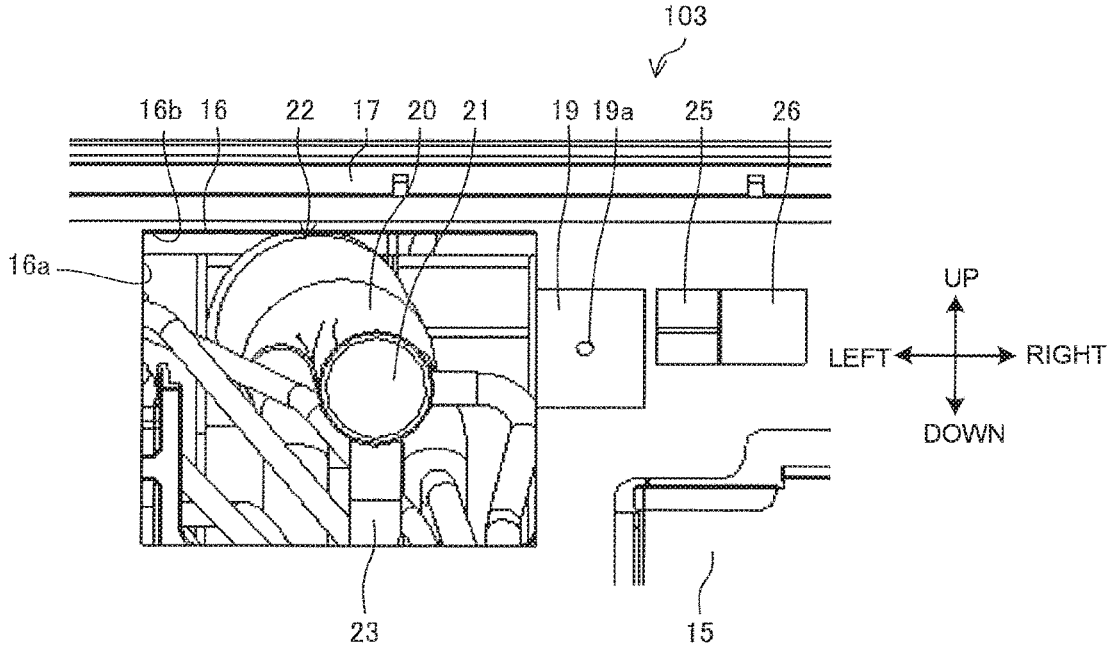
FIG. 5 is an enlarged front view of an opening and the air purge valve placed on a rear side in a projection direction of the opening of the indoor unit of the air-conditioning apparatus according to Embodiment 1 of the present disclosure.
Figure 6:
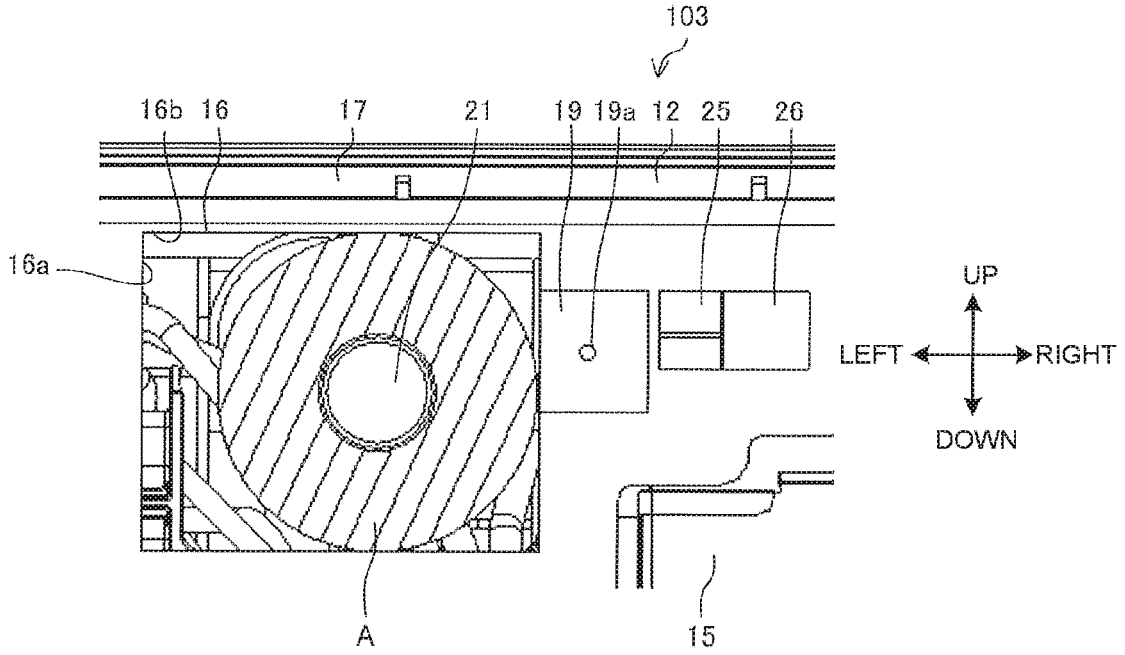
FIG. 6 is an enlarged front view of the opening and an operating range of the air purge valve in the opening of the indoor unit of the air-conditioning apparatus according to Embodiment 1 of the present disclosure.

FIG. 3 is an enlarged perspective view of a part of the indoor unit 103 of the air-conditioning apparatus 100 with the cover 30 removed according to Embodiment 1 of the present disclosure. FIG. 4 is an enlarged longitudinal-sectional view of the cover 30 and the air purge valve 21 of the indoor unit 103 of the air-conditioning apparatus 100 according to Embodiment 1 of the present disclosure. FIG. 5 is an enlarged front view of the opening 16 and the air purge valve 21 placed on a rear side in a projection direction of the opening 16 of the indoor unit 103 of the air-conditioning apparatus 100 according to Embodiment 1 of the present disclosure. FIG. 6 is an enlarged front view of the opening 16 and an operating range A of the air purge valve 21 in the opening 16 of the indoor unit 103 of the air-conditioning apparatus 100 according to Embodiment 1 of the present disclosure.

As shown in FIGS. 3 and 4, the indoor unit 103 includes an air processing unit 22 including the air reservoir 20 and the air purge valve 21. The air processing unit 22 is located at the top of the water circuit 105 formed in the indoor unit 103 as a heat medium flow path allowing water to flow through the indoor heat exchanger 7. The air processing unit 22 is located at the top inside the casing 11.

The air purge valve 21 discharges air accumulated in the air reservoir 20 during water charge into the water circuit 105. When open, the air purge valve 21 allows for communication between the air reservoir 20 and an air hose 23 and discharges air along with the charged water onto a drain pan (not shown) in the indoor unit 103 through the air hose 23.

As shown in FIG. 4, the air reservoir 20 and the air purge valve 21 of the air processing unit 22 are composed of one rigid unit 24 to ensure easy operation by the user. For example, the rigid unit 24 may consist of one metal unit or metal units joined to each other. The air purge valve 21 is located within reach of the user's fingers from the opening 16 so that the user can easily operate the air purge valve 21 by inserting his/her fingers through the opening 16.

Inside the casing 11, the air purge valve 21 is located on the rear side of the opening 16 in the projection direction, as shown in FIG. 5. This allows the user to recognize that the air purge valve 21 is present behind the opening 16 when viewed from the front side of the indoor unit 103.

As shown in FIG. 5, the opening 16 is formed in an upper part of the side of the casing 11 with its upper edge 16*b* extending horizontally along an edge 17 of a top face of the casing 11. The opening 16 has a square shape conforming to the cover body 32 of the cover 30. At the inner periphery of the opening 16, there is an inner peripheral flange 18 extending to the rear side from the surface of the casing 11, as shown in FIG. 4.

The casing 11 includes a recess 19 on the right side of the opening 16. The recess 19 engages with a positioning piece 33 of the cover 30. The recess 19 is formed with a screw hole 19*a* to receive the insertion of the screw 40 for screw-fixing the cover 30. The casing 11 includes a hole 25 on the right side of the recess 19. The hole 25 receives the insertion of a temporarily fixing tab 34 of the cover 30. To the right of the hole 25, there is an operation recess 26 to allow for operation of a knob 34*a* of the cover 30.

The opening 16, the recess 19, and the hole 25 are arranged in parallel in the horizontal direction. As viewed when the indoor heat exchanger 7 and the electric box 15 are projected to the front side, the opening 16, the recess 19, and the hole 25 are positioned between the indoor heat exchanger 7 and the electric box 15 inside the casing 11. The opening 16 and the hole 25 are spaced from each other at a distance corresponding to that between the left and right ends of the cover 30 closing the opening 16.

As shown in FIG. 6, the air purge valve 21 is located at the center on the rear side of the opening 16 in the projection direction. Behind the opening 16, there is an operating range A around the air purge valve 21 providing a round space for the insertion of the user's fingers.

<Configuration of the Cover 30>

Figure 7:
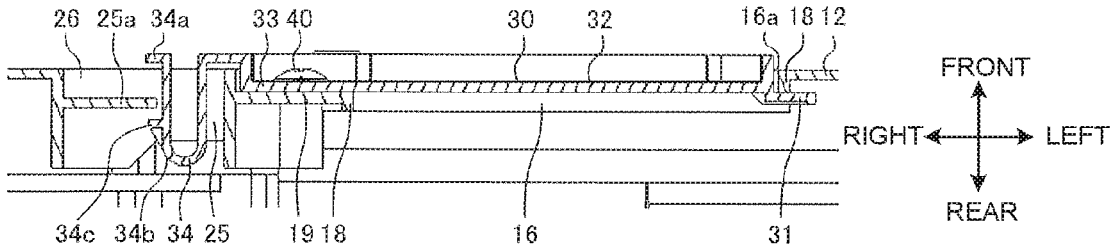
FIG. 7 is an enlarged cross-sectional view of the opening and the cover of the indoor unit of the air-conditioning apparatus according to Embodiment 1 of the present disclosure when the cover is closing the opening.
Figure 8:
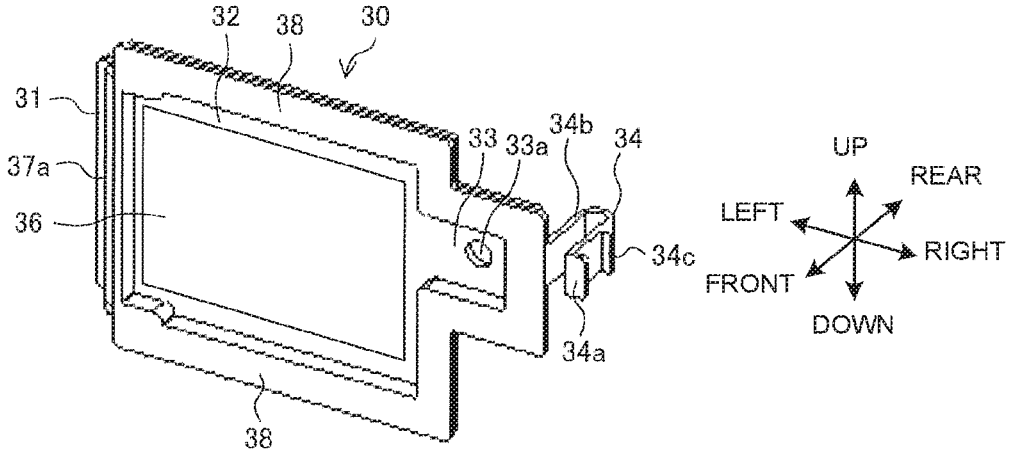
FIG. 8 is a front perspective view of the cover according to Embodiment 1 of the present disclosure.
Figure 9:
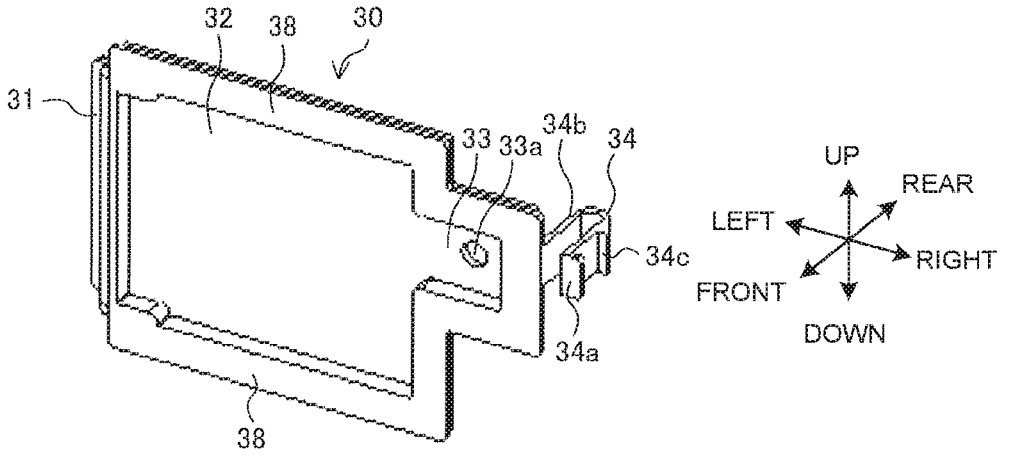
FIG. 9 is a front perspective view of the cover with its operation instruction portion removed according to Embodiment 1 of the present disclosure.
Figure 10:
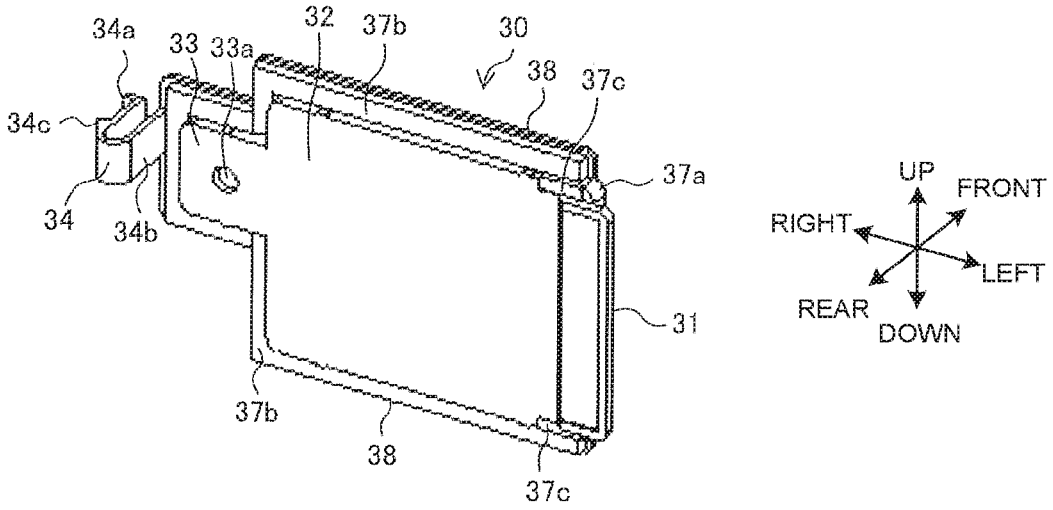
FIG. 10 is a rear perspective view of the cover according to Embodiment 1 of the present disclosure.
Figure 11:
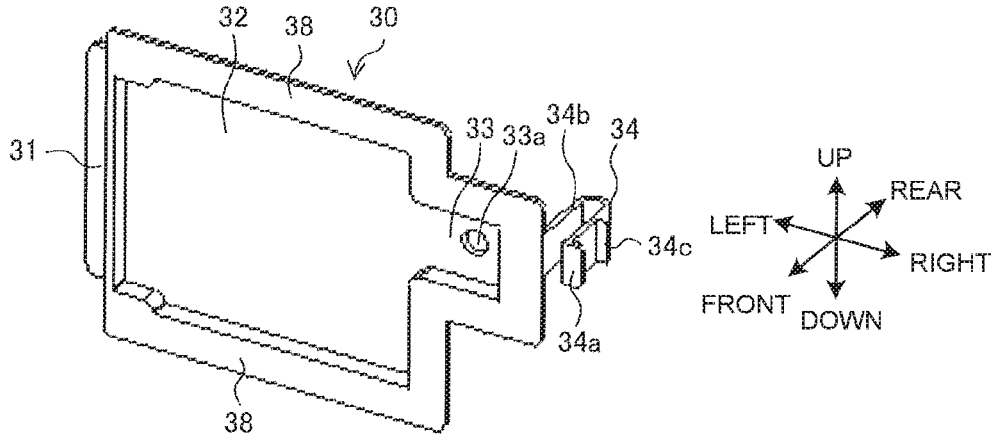
FIG. 11 is a front perspective view of the cover with a seal part removed from a hook according to Embodiment 1 of the present disclosure.
Figure 12:
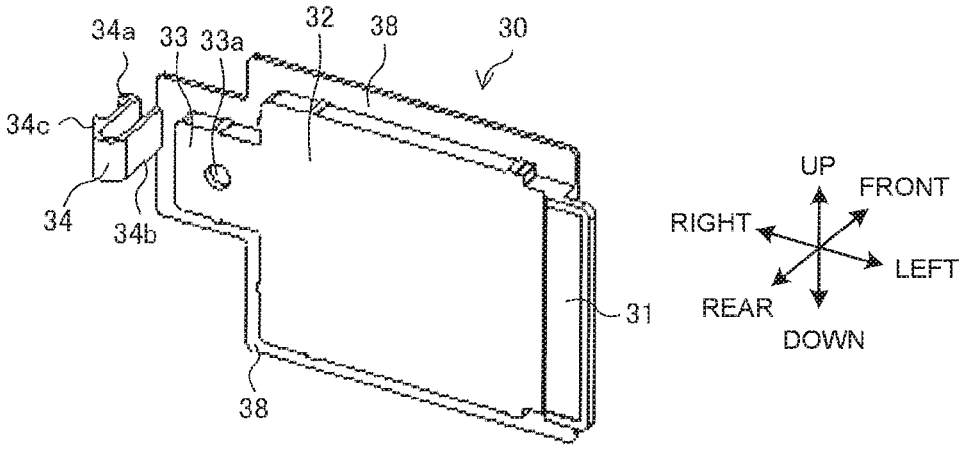
FIG. 12 is a rear perspective view of the cover with a seal part removed from an outer peripheral flange according to Embodiment 1 of the present disclosure.

FIG. 7 is an enlarged cross-sectional view of the opening 16 and the cover 30 of the indoor unit 103 of the air-conditioning apparatus 100 according to Embodiment 1 of the present disclosure when the cover 30 is closing the opening 16. FIG. 8 is a front perspective view of the cover 30 according to Embodiment 1 of the present disclosure. FIG. 9 is a front perspective view of the cover 30 with its operation instruction portion 36 removed according to Embodiment 1 of the present disclosure. FIG. 10 is a rear perspective view of the cover 30 according to Embodiment 1 of the present disclosure. FIG. 11 is a front perspective view of the cover 30 with a seal part 37*a* removed from a hook 31 according to Embodiment 1 of the present disclosure. FIG. 12 is a rear perspective view of the cover 30 with a seal part 37*b* removed from an outer peripheral flange 38 according to Embodiment 1 of the present disclosure.

As shown in FIGS. 7 to 11, the cover 30 includes the cover body 32 closing the opening 16. The cover body 32 has a square shape with an outer periphery conforming to the inner periphery of the square opening 16.

On the left side 16*a* of the cover 30 as viewed from the front of the cover 30, there is a hook 31 protruding from the cover body 32. The hook 31 of the cover 30 is provided at the left end of the cover 30 in the horizontal direction of the casing 11 as viewed from the front of the cover 30. The hook 31 has a width to span between upper and lower ends of the left side 16*a*.

The cover 30 includes, on its side opposite to the side 16*a*, a temporarily fixing tab 34 for temporarily fixing the cover 30 to the casing 11 with the cover body 32 closing the opening 16. The temporarily fixing tab 34 is provided on the right end of the cover 30 in the horizontal direction of the casing 11 as viewed from the front of the cover 30.

The hook 31 and the temporarily fixing tab 34 may be provided on either end of the cover 30 in the horizontal direction of the casing 11 such that the hook 31 and the temporarily fixing tab 34 face each other.

The temporarily fixing tab 34 includes a knob 34*a*, a deformation part 34*b*, and a barb 34*c*.

With the cover body 32 closing the opening 16, the knob 34*a* is exposed from the casing 11 and held by the user.

The deformation part 34*b* deforms in response to the user operating the knob 24*a*, whereby the temporarily fixing tab 34 is released from the casing 11. The deformation part 34*b* has a U-shaped cross-section. When the user moves the knob 24*a* to the left, the U-shaped deformation part 34*b* is compressed, allowing the temporarily fixing tab 34 to be pulled out of the hole 25. The deformation part 34*b* has the U-shaped cross-section such that the deformation part 34*b* is elastically resilient to compression. However, the deformation part 34*b* is not limited to this. The deformation part 34*b* may be made of rubber or resin such that the deformation part 34*b* is elastically resilient to compression.

The barb 34*c* is provided on the outer left side of the U-shaped deformation part 34*b*. The barb 34*c* hangs on an inner peripheral edge 25*a* of the hole 25, preventing the temporarily fixing tab 34 from coming off by itself when the cover 30 is temporarily fixed.

A positioning piece 33 is provided between the cover body 32 and the temporarily fixing tab 34 of the cover 30. The positioning piece 33 fits into the recess 19 on the surface of the casing 11. The positioning piece 33 is smaller than the cover body 32. The positioning piece 33 tightly fits into the recess 19. In contrast, the cover body 32 loosely fits into the opening 16 to allow for easy attachment and removal. The positioning piece 33 includes a screw-fixing part 33*a* through which the cover 30 is fixed to the casing 11 with the screw 40. The screw-fixing part 33*a* is a hole positioned collinearly with the screw hole 19*a* in the recess 19 of the casing 11 to enable screw-fixing. The positioning piece 33 may have any shape that can fit into the recess 19 on the surface of the casing 11, and various shapes can be applied to the positioning piece 33.

The outer peripheral flange 38 is provided on an outer periphery of the cover 30 except along the hook 31. The outer peripheral flange 38 projects outward from the cover 30 with the cover body 32 relatively positioned on the rear side of the casing 11.

As shown by the comparison between FIGS. 9 and 11, the hook 31 of the cover 30 includes, on its front side, a seal part 37*a* for forming a seal with the inner periphery of the opening 16. The seal part 37*a* is attached to the entire hook 31. Upper and lower ends of the seal part 37*a* stick out from the hook 31 of the cover 30.

As shown by the comparison between FIGS. 10 and 12, the outer peripheral flange 38 of the cover 30 includes, on its back side, or rear side, a seal part 37*b* for forming a seal with the inner periphery of the opening 16. The seal part 37*b* is attached to the entire outer peripheral flange 38.

As shown in FIG. 10, the seal part 37*b* of the outer peripheral flange 38 of the cover 30 is provided such that two ends of the seal part 37*b* on the hook 31 side of the cover 30 stick out from the outer peripheral flange 38. The two sticking-out ends of the seal part 37*b* of the outer peripheral flange 38 are attached to and placed atop the sticking-out portion of the seal part 37*a* of the hook 31. The sticking-out portions of the seal parts 37*a*, 37*b* and overlapping portions 37*c* of the two seal parts 37*a*, 37*b* stick out in the upper and lower directions from the upper and lower ends, respectively, of the hook 31, and they do not go beyond the uppermost and lowermost parts of the outer peripheral flange 38 but stay within the height of the outer peripheral flange 38. The overlapping portions 37*c* stay within the left-right width of the hook 31. The overlapping portions 37*c* are positioned on the seal part 37*b* side of the outer peripheral flange 38 relative to the seal part 37*a* of the hook 31; that is, the overlapping portions 37*c* are retracted to the rear side of the cover 30.

The seal parts 37*a*, 37*b* are attached to the cover 30, which allows sealing a gap between the cover 30 and the panel 12 of the casing 11. This prevents air from bypassing the filter of the indoor unit 103 and flowing through the gap. This also prevents dirt around the cover 30 that might be caused by air passing through the gap. The two overlapping portions 37*c* of the seal parts 37*a*, 37*b* are positioned on the rear side of the cover 30 relative to the seal part 37*a* of the hook 31, and this makes the seal part 37*a* of the hook 31 hardly come off.

When attaching the seal parts 37*a*, 37*b* to the cover 30, a manufacturer first attaches the seal part 37*a* to the hook 31 to the cover 30. The manufacturer then attaches the seal part 37*b* to the outer peripheral flange 38 running along the entire periphery of the cover 30 except the hook 31.

As shown in FIG. 8, the operation instruction portion 36 showing user operation is provided on the surface of the cover 30. For example, the operation instruction portion 36 displays procedures for operating the air purge valve 21.

<Attachment of the Cover 30>

Figure 13:
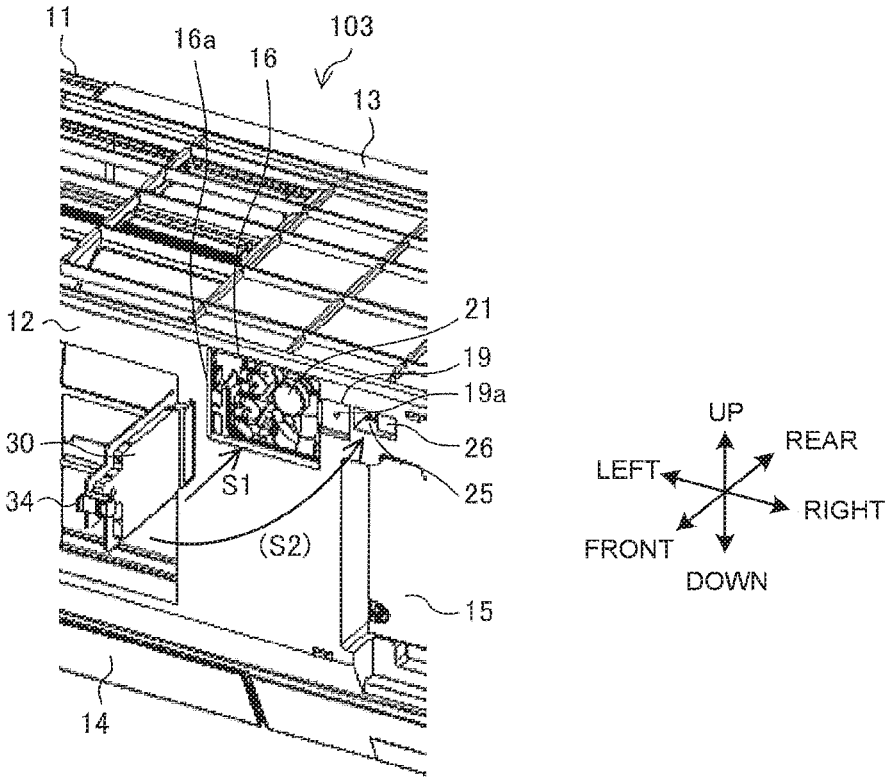
FIG. 13 is a perspective view illustrating how the hook of the cover according to Embodiment 1 of the present disclosure engages on an inner periphery of the opening.
Figure 14:
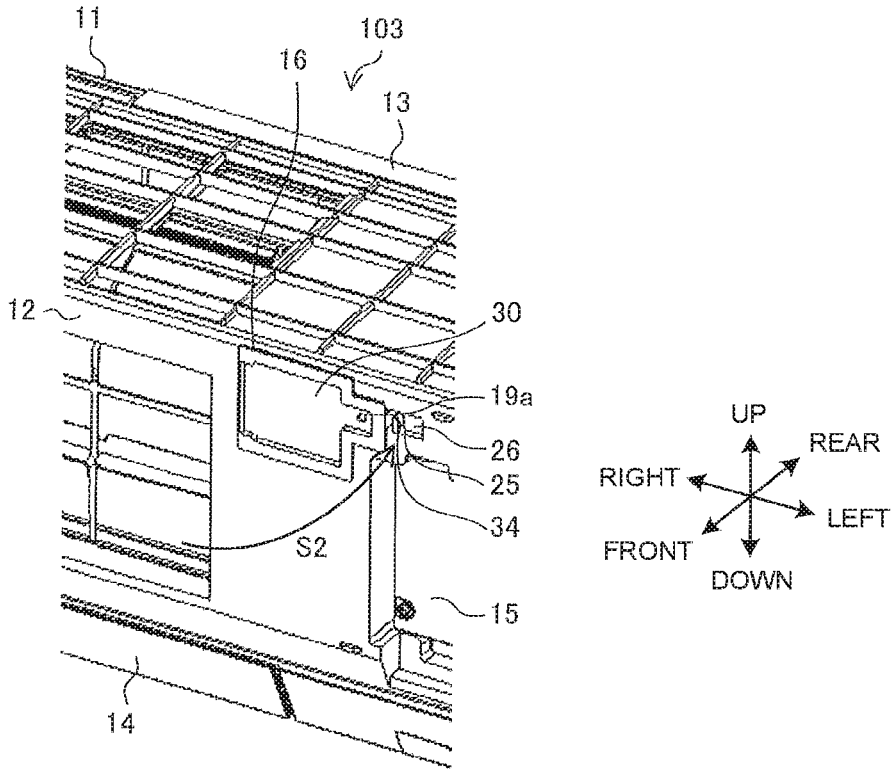
FIG. 14 is a perspective view illustrating how a temporarily fixing tab of the cover according to Embodiment 1 of the present disclosure is temporarily fixed to a casing.
Figure 15:
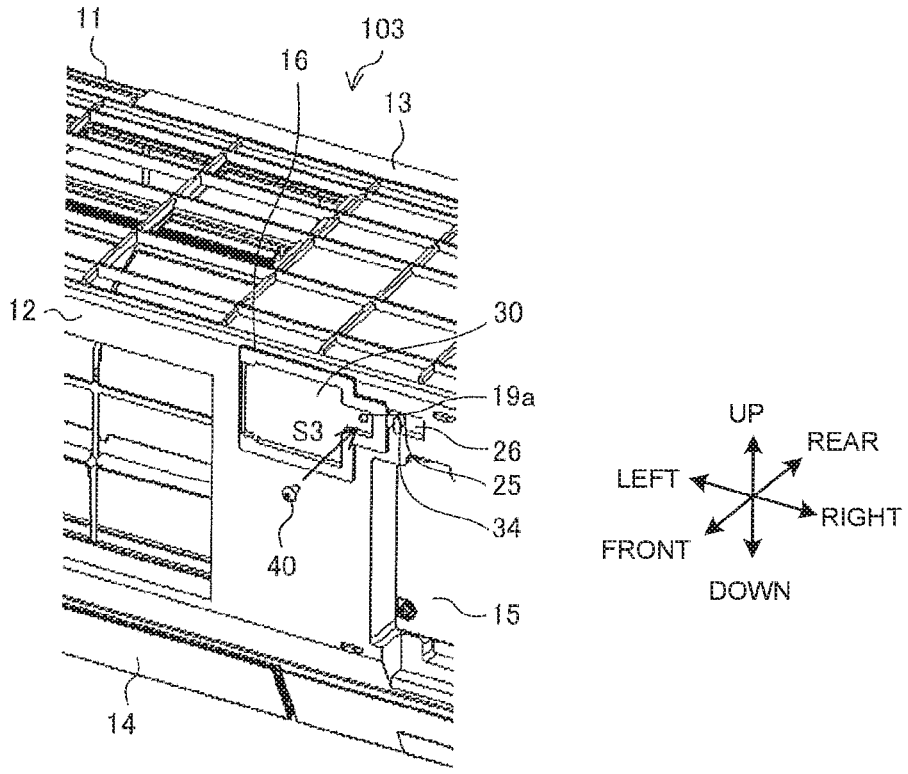
FIG. 15 is a perspective view illustrating how the cover according to Embodiment 1 of the present disclosure is fixed to the casing with a screw.

FIG. 13 is a perspective view illustrating how the hook 31 of the cover 30 according to Embodiment 1 of the present disclosure engages on the inner periphery of the opening 16. FIG. 14 is a perspective view illustrating how the temporarily fixing tab 34 of the cover 30 according to Embodiment 1 of the present disclosure is temporarily fixed to the casing 11. FIG. 15 is a perspective view illustrating how the cover 30 according to Embodiment 1 of the present disclosure is fixed to the casing 11 with the screw 40.

As shown in FIG. 13, in attaching the cover 30 to the opening 16, the user first engages the hook 31 of the cover 30 on the opening 16. Specifically, the user holds a portion of the cover 30 such as the cover body 32 and makes it upright relative to the side of the casing 11 formed with the opening 16. Then, the user moves the cover 30 in the direction indicated by the arrow S1 in the figure to insert the hook 31 into the opening 16. In this way, the hook 31 can be inserted into the opening 16 in the state where the cover 30 is made upright relative to the side of the casing 11. This makes the hook part easily recognizable.

As shown in FIG. 14, the user rotates the cover 30 about its hook 31 engaging on the inner periphery of the opening 16 in the direction indicated by the arrow S2 in the figure to close the opening 16. The user thus inserts the temporarily fixing tab 34 of the cover 30 into the hole 25 of the casing 11 to temporarily fix the cover 30. At this time, the positioning piece 33 completely fits into the recess 19 of the casing 11.

As shown in FIG. 15, with the cover 30 temporarily fixed to the casing 11, the user puts the screw 40 in the direction indicated by the arrow S3 in the figure into the hole of the screw-fixing part 33*a* of the cover 30 and the screw hole 19*a* of the casing 11. This fixes the cover 30.

<Removal of the Cover 30>

In removing the cover 30, the user first removes the screw 40 fixing the cover 30. The user then inserts his/her fingers into the operation recess 26 of the casing 11 and pushes the knob 24*a* to the left side, closer to the positioning piece 33, to deform the deformation part 34*b* and disengage the barb 34*c*. The user then pulls the knob 34*a* out of the operation recess 26 and removes the temporarily fixing tab 34 of the cover 30 from the hole 25. Subsequent procedure is reverse to that for attaching the cover 30.

<Effects of Embodiment 1>

According to Embodiment 1, the indoor unit 103 of the air-conditioning apparatus 100 includes the opening 16 in the casing 11. The indoor unit 103 includes the cover 30 including the cover body 32 to close the opening 16. The indoor unit 103 includes the indoor heat exchanger 7 as a heat medium heat exchanger exchanging heat between water as a heat medium and indoor air. The indoor unit 103 includes the air processing unit 22 located at the top of the water circuit 105 for circulation of water in the indoor heat exchanger 7. The air processing unit 22 includes the air reservoir 20 and the air purge valve 21 for discharging air in the air reservoir 20. The air purge valve 21 is located on the rear side in the projection direction of the opening 16 inside the casing 11. The cover 30 includes, on its side 16*a*, the single hook 31 protruding from the cover body 32. The cover 30 includes, on its side opposite to the side 16*a*, the temporarily fixing tab 34 for temporarily fixing the cover 30 to the casing 11 with the cover body 32 closing the opening 16.

With this configuration, the user can finish the hooking work just by engaging the single hook 31 provided on the side 16*a* of the cover 30 onto the inner periphery of the opening 16 of the casing 11. This allows for easy attachment of the cover 30. The cover 30 includes only one hook 31 on its side 16*a*, providing visibility so that the user can easily see the hooking part. This allows the user to easily attach the cover 30 under good visibility conditions.

The casing 11, in which pipes and wires are connected, has the opening 16, and thus the user can easily access the air purge valve 21 for installation or maintenance work through the opening 16 with the panel 12 attached to the casing 11.

The cover 30 can be temporarily fixed to the panel 12 of the casing 11. This eliminates the need for supporting the cover 30 at all times during installation or maintenance.

This, in turn, facilitates attachment or removal of the screw 40, improving work efficiency.

According to Embodiment 1, the hook 31 has a width to span between both ends of the side 16*a*.

With this configuration, once the single hook 31 at the side 16*a* of the cover 30 engages on the inner periphery of the opening 16 in the casing 11, the cover 30 does not wobble and becomes stable. This allows for easy attachment of the cover 30, which is to be rotated to be closed prior to the temporary fixing. In Embodiment 1, the overlapping portions 37*c* of the seal parts 37*a*, 37*b* stick out from the upper and lower ends of the hook 31. Accordingly, it is preferable that the hook 31 have the width slightly smaller than that between the ends of the side 16*a* of the opening 16 to ensure that the overlapping portions 37*c* of the seal parts 37*a*, 37*b* do not interfere with the opening 16.

According to Embodiment 1, the positioning piece 33 for fitting into the recess 19 on the surface of the casing 11 is provided between the cover body 32 and the temporarily fixing tab 34 of the cover 30.

With this configuration, once the single hook 31 engages on the inner periphery of the opening 16 and the temporarily fixing tab 34 temporarily fixes the cover 30 with the cover body 32 closing the opening 16, the positioning piece 33 fits into the recess 19 on the surface of the casing 11. This allows temporarily fixing the cover 30 to the opening 16 as prescribed. This allows for easy attachment of the cover 30 until it is temporarily fixed.

According to Embodiment 1, the positioning piece 33 includes the screw-fixing part 33*a* through which the cover 30 is fixed to the casing 11 with the screw 40.

With this configuration, once the positioning piece 33 fits into the recess 19 of the casing 11 and the cover 30 is temporarily fixed to the opening 16 as prescribed, the screw-fixing part 33*a* overlaps the screw hole 19*a*. This allows the user to fix the cover 30 by putting the screw 40 into the screw-fixing part 33*a*. This allows for easy attachment of the cover 30 until it is fixed.

According to Embodiment 1, the temporarily fixing tab 34 includes the knob 34*a*. With the cover body 32 closing the opening 16, the knob 34*a* is exposed from the casing 11 and held by the user. The temporarily fixing tab 34 also includes the deformation part 34*b*. In response to the user operating the knob 34*a*, the deformation part 34*b* deforms to allow the temporarily fixing tab 34 to be released from the casing 11.

With this configuration, the surface of the casing 11 only needs to be formed with the hole 25 to receive the temporarily fixing tab 34 on its inner periphery for temporary fixing of the temporarily fixing tab 34. This simplifies the manufacturing process.

According to Embodiment 1, the cover 30 includes, on its outer periphery except along the hook 31, the outer peripheral flange 38 protruding from the cover body 32.

With this configuration, once the single hook 31 engages on the inner periphery of the opening 16 and the temporarily fixing tab 34 temporarily fixes the cover 30 with the cover body 32 closing the opening 16, the outer peripheral flange 38 surrounds the opening 16 of the casing 11. This facilitates closure of the opening 16 by the cover 30.

According to Embodiment 1, the hook 31 and the outer peripheral flange 38 of the cover 30 are provided with the seal parts 37*a*, 37*b*, respectively, for forming a seal with the inner periphery of the opening 16.

With this configuration, a gap between the cover 30 and the opening 16 is sealed by the seal parts 37*a*, 37*b*. This prevents air circulating inside the casing 11 from leaking through the gap between the cover 30 and the opening 16. The seal parts 37*a*, 37*b* also prevent dirt around the cover 30.

According to Embodiment 1, the inner periphery of the opening 16 is formed with the inner peripheral flange 18 extending inward from the surface of the casing 11.

This configuration makes the inner periphery of the opening 16 unsharpened, preventing finger injuries when the user inserts his/her fingers into the opening 16.

According to Embodiment 1, the cover 30 includes, on its surface, the operation instruction portion 36 showing user operation.

This configuration makes the operation instruction portion 36 easily noticeable by the user during installation or maintenance, improving user awareness.

According to Embodiment 1, the air reservoir 20 and the air purge valve 21 of the air processing unit 22 are composed of one rigid unit 24.

This configuration allows for easy handling and assembly of the air processing unit 22 as it comes as a single unit. Also, the air purge valve 21 is completely fixed inside the casing 11 with the rigid unit 24 including the air reservoir 20 on the upstream side of the air flow. This prevents the air purge valve 21 from wobbling as the user operates the air purge valve 21, making the air purge valve 21 easy to be operated. This configuration also allows locating the air purge valve 21 at a high position, which leads to efficient air purging.

According to Embodiment 1, the air processing unit 22 is located at the top inside the casing 11. The opening 16 is formed in the upper part of the side of the casing 11 with its upper edge 16*b* extending along the edge 17 of the top face of the casing 11. The hook 31 of the cover 30 is provided on one of the ends of the cover 30 in the horizontal direction of the casing 11. The temporarily fixing tab 34 of the cover 30 is provided on the other one of the ends of the cover 30 in the horizontal direction of the casing 11. Instead of the side of the casing 11, the opening 16 may be formed in the top face, the bottom face, or the rear face of the casing 11.

The above configuration requires that the hook 31 and the temporarily fixing tab 34 of the cover 30 be arranged to face each other. When the air reservoir 20 is to be located at the top of the water circuit 105, which is a heat medium flow path, inside the casing 11 to purge air from the water circuit 105, any downsizing of the indoor unit 103 inevitably results in the air processing unit 22 being located at the top inside the casing 11. In that case, the opening 16 is formed in the upper part of the side of the casing 11 with its upper edge 16*b* extending along the edge 17 of the top face of the casing. Then if the hook of the cover is to be positioned at the lower part of the casing and the temporarily fixing tab of the cover is to be positioned at the upper part of the casing, there would be no space for placing the temporarily fixing tab. Also if the hook of the cover is to be positioned at the upper part of the casing and the temporarily fixing tab is to be positioned at the lower part of the casing, the temporarily fixing tab would interfere with other components inside the casing and thus there would be no space for placing the temporarily fixing tab. Hence, the hook 31 of the cover 30 is provided on one of the ends of the cover 30 in the horizontal direction of the casing 11, and the temporarily fixing tab 34 is provided on the other one of the ends of the cover 30 in the horizontal direction of the casing 11. This eliminates waste of placement space inside the indoor unit 103.

When the hook 31 of the cover 30 is provided on either end of the cover 30 in the horizontal direction of the casing 11, the hook 31 preferably engages on a left or right inner periphery of the opening 16. And when the hook 31 has a width to span between both ends of the side 16*a*, a lower end of the hook 31 of the cover 30 gets held by the lower inner periphery of the opening 16. In the case where the overlapping portion 37*c* of the seal parts 37*a*, 37*b* sticks out as in Embodiment 1, the overlapping portion 37*c* gets held by the lower inner periphery of the opening 16. This prevents the user from dropping the cover 30 by mistake during work. This allows the user to easily attach the cover 30 under good visibility conditions.

According to Embodiment 1, the air-conditioning apparatus 100 includes the indoor unit 103.

With this configuration, the user can finish the hooking work just by engaging the single hook 31 provided on the side 16*a* of the cover 30 onto the inner periphery of the opening 16 in the casing 11 of the indoor unit 103 of the air-conditioning apparatus 100. This allows for easy attachment of the cover 30. The cover 30 includes only one hook 31 on its side 16*a*, providing visibility so that the user can easily see the hooking part. This allows the user to easily attach the cover 30 under good visibility conditions.

<Other Notes>

The above embodiment has described the wall-mounted indoor unit. The present disclosure is, however, not limited to this; the indoor unit of the air-conditioning apparatus of the present disclosure may be any other indoor unit such as a floor type indoor unit or a ceiling concealed indoor unit.

REFERENCE SIGNS LIST

1 compressor 2 four-way valve 3 outdoor heat exchanger 4 expansion valve 5 heat-transferring heat exchanger 6 pump 7 indoor heat exchanger 10 grille 11 casing 12 panel 13 box 14 vane 15 electric box 16 opening 16*a* side 16*b* upper edge 17 edge 18 inner peripheral flange 19 recess 19*a* screw hole 20 air reservoir 21 air purge valve 22 air processing unit 23 air hose 24 rigid unit 25 hole 25*a* inner periphery 26 operation recess 30 cover 31 hook 32 cover body 33 positioning piece 33*a* screw-fixing part 34 temporarily fixing tab 34*a* knob 34*b* deformation part 34*c* barb 36 operation instruction portion 37*a* seal part 37*b* seal part 37*c* overlapping portion 38 outer peripheral flange 40 screw 100 air-conditioning apparatus 101 outdoor unit 102 relay unit 103 indoor unit 104 refrigerant circuit 105 water circuit

The invention claimed is:

1. An indoor unit of an air-conditioning apparatus, the indoor unit comprising:

an opening provided in a casing;

a cover including a cover body configured to close the opening;

a heat medium heat exchanger disposed inside the casing, the heat medium heat exchanger being configured to exchange heat between a heat medium and indoor air; and an air processing unit located at a top of a heat medium flow path configured to allow the heat medium to flow through the heat medium heat exchanger, the air processing unit including an air reservoir and an air purge valve configured to discharge air in the air reservoir, wherein the air purge valve is positioned on a rear side in a projection direction of the opening inside the casing, the cover includes, on one side thereof, a single hook protruding from the cover body, and the cover includes, on an other side thereof opposite to the one side, a temporarily fixing tab configured to temporarily fix the cover to the casing with the cover body closing the opening.

2. The indoor unit of an air-conditioning apparatus of claim 1, wherein the hook has a width to span between both ends of the one side.

3. The indoor unit of an air-conditioning apparatus of claim 1, wherein the cover includes a positioning piece between the cover body and the temporarily fixing tab, the positioning piece being configured to fit in a recess on a surface of the casing.

4. The indoor unit of an air-conditioning apparatus of claim 3, wherein the positioning piece includes a screw-fixing part through which the cover is fixed with a screw to the casing.

5. The indoor unit of an air-conditioning apparatus of claim 1, wherein the temporarily fixing tab includes a knob and a deformation part, the knob being configured to be exposed from the casing and held by a user with the cover body closing the opening, the deformation part being configured to, by user operation of the knob, deform and release the temporarily fixing tab from the casing.

6. The indoor unit of an air-conditioning apparatus of claim 1, wherein the cover includes, on an outer periphery thereof except along the hook, an outer peripheral flange configured to protrude from the cover body.

7. The indoor unit of an air-conditioning apparatus of claim 6, wherein each of the hook and the outer peripheral flange of the cover is provided with a seal part configured to form a seal with an inner periphery of the opening.

8. The indoor unit of an air-conditioning apparatus of claim 1, wherein the opening includes, on an inner periphery thereof, an inner peripheral flange configured to extend inward from a surface of the casing.

9. The indoor unit of an air-conditioning apparatus of claim 1, wherein the cover includes, on a surface thereof, an operation instruction portion showing user operation.

10. The indoor unit of an air-conditioning apparatus of claim 1, wherein the air reservoir and the air purge valve of the air processing unit are composed of a single rigid unit.

11. The indoor unit of an air-conditioning apparatus of claim 1, wherein the air processing unit is located at a top inside the casing, the opening is formed in an upper part of a side of the casing with an upper edge of the opening extending along an edge of a top face of the casing, the hook of the cover is provided on one end of the cover in a horizontal direction of the casing, and the temporarily fixing tab of the cover is provided on an other end of the cover in the horizontal direction of the casing.

12. An air-conditioning apparatus comprising the indoor unit of an air-conditioning apparatus of claim 1.

* * * * *